US010279967B2

(12) United States Patent
Wei

(10) Patent No.: US 10,279,967 B2
(45) **Date of Patent: *May 7, 2019**

(54) SEALING COVER FOR CONTAINERS WITH INCREASED HEAT RESISTANCE, EASY-OPENING PERFORMANCE AND SEALABILITY

(71) Applicant: SEAL AND PACK CO., LTD., Icheon-si, Gyeonggi-do (KR)

(72) Inventor: Se-Hwang Wei, Yongin-si (KR)

( * ) Notice: Subject to any disclaimer, the term of this patent is extended or adjusted under 35 U.S.C. 154(b) by 277 days.

This patent is subject to a terminal disclaimer.

(21) Appl. No.: 14/162,563

(22) Filed: Jan. 23, 2014

(65) Prior Publication Data

US 2015/0166234 A1 Jun. 18, 2015

(30) Foreign Application Priority Data

Dec. 17, 2013 (KR) ..... 10-2013-0157240

(51) Int. Cl.
*B65D 53/06* (2006.01)
*B65D 77/20* (2006.01)
(Continued)

(52) U.S. Cl.
CPC ..... *B65D 53/06* (2013.01); *B65D 41/325* (2013.01); *B65D 51/20* (2013.01);
(Continued)

(58) Field of Classification Search
CPC ..... Y10T 428/15; B32B 27/32; B32B 27/36; B32B 27/06; B32B 15/08; B32B 15/09
(Continued)

(56) References Cited

U.S. PATENT DOCUMENTS 3,142,412 A * 7/1964 Blakeslee ..... B65D 17/506 220/270
4,501,375 A * 2/1985 Katsura ..... B65D 17/163 220/270

(Continued)

FOREIGN PATENT DOCUMENTS

DE 102004063280 A1 * 7/2006 ..... B65D 17/4011
JP 2012-081999 A 4/2012

(Continued)

OTHER PUBLICATIONS

Ebnesajjad, Sina. (2011). Handbook of Adhesives and Surface Preparation—Technology, Applications and Manufacturing—8. Characteristics of Adhesive Materials. Elsevier. Online version available at: app.knovel.com/hotlink/pdf/id:kt008TYD81/handbook-adhesives-surface/characteristics-adhesive.*

(Continued)

*Primary Examiner* — Maria V Ewald
*Assistant Examiner* — Ethan A. Utt
(74) *Attorney, Agent, or Firm* — Antonio Ha & U.S. Patent, LLC

(57) ABSTRACT

A sealing cover for containers with increased heat resistance, easy-opening performance and sealability is provided. The sealing cover includes an upper layer which is provided with the opening tab, and a lower layer which includes an aluminum foil and a heat sealing adhesive layer thermally-adhering to the container. The upper layer and the lower layer are integrated with each other via thermal adhesion using a heat adhesive resin or film.

7 Claims, 6 Drawing Sheets

(51) Int. Cl.
*B65D 51/20* (2006.01)
*B65D 41/32* (2006.01)

(52) U.S. Cl.
CPC ..... *B65D 77/2024* (2013.01); *B65D 77/2044* (2013.01); *B65D 77/2096* (2013.01); *B65D 2251/0093* (2013.01); *B65D 2577/205* (2013.01)

(58) Field of Classification Search
USPC ..... 428/43; 220/270, 260–286, 254, 220/254.1–254.9, 256, 258, 256.1, 220/258.1–258.5, 359, 359.1–359.5, 220/711–715, FOR. 203; 215/232, 250, 215/253–256, 295, 305, 316, 341, 215/347–352; 222/153, 153.01, 222/153.05–153.07, 541, 541.1, 541.6, 222/541.9; D9/416, 435, 438, 518, 901
See application file for complete search history.

(56) References Cited

U.S. PATENT DOCUMENTS 4,960,216 A * 10/1990 Giles ..... B65D 51/20 215/232
5,125,528 A * 6/1992 Heyn ..... B29C 45/14336 220/269
5,131,556 A * 7/1992 Iioka ..... B65D 17/163 220/270
5,514,442 A * 5/1996 Galda ..... B65D 51/20 215/232
5,830,398 A * 11/1998 Heyn ..... B29C 45/14336 264/154
6,082,566 A * 7/2000 Yousif ..... B32B 15/08 215/232
6,131,754 A * 10/2000 Smelko ..... B65D 53/02 428/462
2004/0043165 A1* 3/2004 Van Hulle ..... B32B 7/12 428/34.2
2004/0105917 A1* 6/2004 Mannion ..... B65D 43/0218 426/110
2006/0124578 A1* 6/2006 Yousif ..... B65D 51/20 215/347
2007/0007229 A1* 1/2007 Yousif ..... B29C 65/76 215/232
2008/0073308 A1* 3/2008 Yousif ..... B65D 77/2024 220/359.3
2008/0233339 A1* 9/2008 Thorstensen-Woll ..... B65D 51/20 428/99
2008/0290091 A1* 11/2008 Shiffer ..... B65D 17/163 220/270
2016/0332771 A1* 11/2016 Wei ..... B65D 51/245

FOREIGN PATENT DOCUMENTS

KR 10-1984-0007700 A 12/1984
KR 10-2009-0003222 A 1/2009
KR 101297028 B1 * 8/2013 ..... B65D 77/2056
KR 101455977 B1 * 11/2014
KR 101648359 B1 * 8/2016
KR 101648360 B1 * 8/2016
KR 101648361 B1 * 8/2016

OTHER PUBLICATIONS

Kutz, Myer. (2007). Handbook of Farm, Dairy, and Food Machinery—22.7 Induction Capsealing. William Andrew Publishing. Online version available at: app.knovel.com/hotlink/pdf/id:kt004R7EN6/handbook-farm-dairy-food/induction-capsealing.*
Machine translation (Espacenet) of DE 102004063280 A1. Translated Jun. 13, 2018. (Year: 2018).*
Machine translation (Espacenet) of KR 10-1455977 B1. Translated Dec. 17, 2018. (Year: 2018).*
Machine translation (Espacenet) of KR 10-1297028 B1. Translated Dec. 17, 2018. (Year: 2018).*

* cited by examiner

FIG. 6A FIG. 6B FIG. 6C FIG. 6D
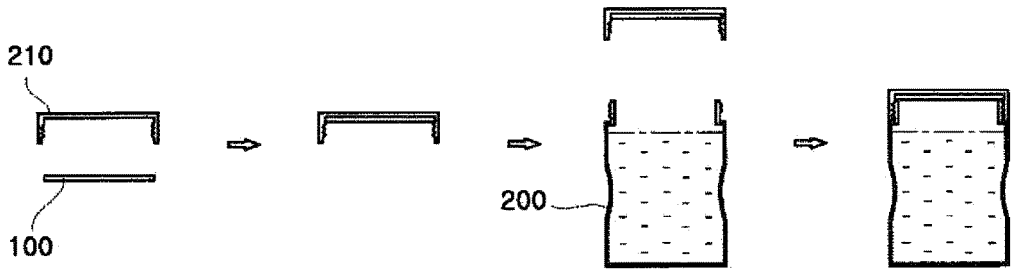
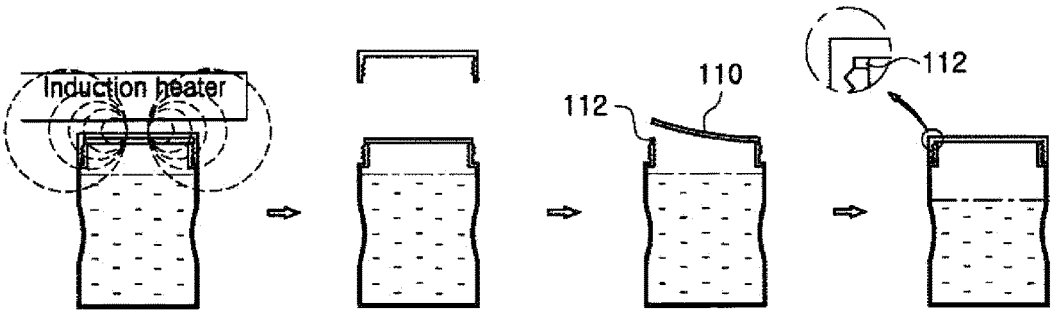
FIG. 6E FIG. 6F FIG. 6G FIG. 6H

SEALING COVER FOR CONTAINERS WITH INCREASED HEAT RESISTANCE, EASY-OPENING PERFORMANCE AND SEALABILITY

BACKGROUND OF THE INVENTION

1. Field of the Invention

The present invention relates generally to sealing covers which seal apertures of containers made of plastic, glass or the like and, more particularly, to a sealing cover for containers which has improved heat resistance, easy-opening performance and sealability.

2. Description of the Related Art

Generally, containers made of plastic, glass or the like have apertures.

The apertures of the containers must be sealed to protect contents contained in the containers or prevent fluid contents from leaking during distribution process of products. Typical caps, caps provided with shock absorption substances on inner surfaces thereof, heat sealing covers sealed on apertures of containers by thermal compression bonding, etc. are being used as sealers for sealing the apertures of the containers.

Formed by foaming polyolefin-based resin, an elastic foamed packing is a representative example of the shock absorption substances provided in the caps. Conduction type heat-seals, high-frequency induction heating seals, etc. are used as the heat sealing covers.

Recently, heat sealing covers are used increasingly to more reliably seal containers.

However, conventional foamed packings have a problem of low airtightness. Conventional heat sealing covers have superior airtightness but it is difficult to open an aperture of a container because a heat sealing cover is sealed on the aperture in such a way that it wraps the aperture. In an effort to overcome the above-mentioned problems, easy peel type heat sealing covers are used sometimes. However, such conventional heat sealing covers are problematic in that they cannot be used in containers for retort products because of low heat resistance.

FIGS. 1A and 1B show examples of a conventional heat sealing cover having an opening tab.

FIG. 1A illustrates a heat sealing cover 20 which is configured such that a central portion thereof can be opened by means of an opening tab 10. In this heat sealing cover 20, an aperture of a container can be opened by the opening tab 10. However, it is difficult to pull contents out because the area of the open portion is comparatively small.

Meanwhile, FIG. 1B illustrates a heat sealing cover 30 which opens in a peeling manner. In the case of the heat sealing cover 30 having such a structure, the area of an opening portion can be as large as desired. However, since the entirety of the heat sealing cover 30 is peeled off, the sealing function is lost. That is, after the heat sealing cover 30 is peeled off, even when the container is covered with a cap again, leakage of fluid contents may be caused because of reduced close-contactability between the container and the cap.

Furthermore, the conventional heat sealing covers shown in FIGS. 1A and 1B are not adapted for retort products because of low heat resistance. Retort products are generally treated by vacuum sterilization at a high temperature of 130° C. or more after the apertures of containers therefor have been sealed. If the heat resistance of the heat sealing cover is unsatisfactory, internal heat of the container is diffused to the outside through the heat sealing cover. As a result, the cap, inside which the heat sealing cover is disposed, may be damaged by heat transferred thereto through the heat sealing cover.

PATENT DOCUMENT

Korean Patent Laid-open Publication No. 10-2009-0003222 (date: Jan. 9, 2009)

Korean Patent Laid-open Publication No. 10-1984-0007700 (date: Dec. 10, 1984)

Japanese Patent Laid-open Publication No. P2012-81999 (date: Apr. 26, 2012)

SUMMARY OF THE INVENTION

Accordingly, the present invention has been made keeping in mind the above problems occurring in the prior art, and an object of the present invention is to provide a sealing cover for containers which has superior heat resistance so that it can be applied not only to a container for general purposes but also to a container for retort products.

Another object of the present invention is to provide a sealing cover for containers which has an opening structure capable of easy-opening and an opening area as large as needed to facilitate removal of contents from the container.

A further object of the present invention is to provide a sealing cover for containers which can provide a secondary sealing effect in which because a part of the sealing cover remains on a lip of an aperture of the container in an annular shape after the sealing cover has opened, when the container is covered with a cap again, the close contact between the container and the cap can be ensured by the elasticity and the shock absorbing effect of the remaining part of the sealing cover, thus reliably preventing contents from leaking.

In order to accomplish the above object, the present invention provides a sealing cover for containers, sealed on an aperture of a container by heat adhesion and configured such that the aperture of the container is opened by pulling an opening tab provided on an upper surface of the sealing cover, the sealing cover including: an upper layer provided with the opening tab; and a lower layer comprising an aluminum foil and a heat sealing adhesive layer thermally-adhering to the container, the upper layer and the lower layer being integrated with each other via thermal adhesion using a heat adhesive resin or film.

The upper layer may include a surface layer made of a polyester or polypropylene film that has no heat adhesive properties and has a thickness ranging from 0.012 mm to 0.04 mm.

The upper layer may include an intermediate substrate layer laminated under the surface layer, the intermediate substrate layer being made of a polyolefin-based foam film having a thickness ranging from 0.03 mm to 2 mm.

The upper layer may include a polyester film laminated under the intermediate substrate layer, the polyester film having a thickness ranging from 0.015 mm to 0.2 mm and made of material making the upper layer have increased tensile strength so that when the opening tab is pulled, the sealing cover can easily open without the opening tab being snapped.

The upper layer may include a first polypropylene film having heat-adhesive property and laminated under the polyester film, the first polypropylene film having a thickness ranging from 0.02 mm to 0.06 mm and being able to thermally adhere to the lower layer.

The lower layer may further include a second polypropylene film thermally-adhering to the first polypropylene film disposed at a lower end of the upper layer, the second polypropylene film being made of a same heat-adhesive material as a material of the first polypropylene film.

The aluminum foil may be laminated under the second polypropylene film and has a thickness ranging from 0.012 mm to 0.1 am, the aluminum foil generating heat by high-frequency induction heating and substantially isolating an interior of the container from an exterior thereof to protect contents in the container.

The heat sealing adhesive layer may be laminated under the aluminum foil and is made of a heat-adhesive polypropylene to thermally-adhere to the container, the heat sealing adhesive layer withstanding a temperature of 130° C. or more and having a thickness ranging from 0.02 mm to 0.08 mm.

The heat sealing adhesive layer may be made of one selected from among polyethylene, polyethylene terephthalate, ionomer and ethylene vinyl acetate.

An annular opening guide cutting band may be formed in the upper layer and configured such that when the opening tab is pulled, the upper layer and the lower layer open along an inner circumferential surface of the aperture of the container in a circumferential shape.

An opening cutting line may be formed in the upper layer along the opening guide cutting band.

An annular heat adhesive sealing band may be formed in the upper layer outside the opening cutting line, the annular heat adhesive sealing band coming into close contact with a lip of the aperture of the container and thermally-adhering to the lip.

BRIEF DESCRIPTION OF THE DRAWINGS

The above and other objects, features and advantages of the present invention will be more clearly understood from the following detailed description taken in conjunction with the accompanying drawings, in which:

FIGS. 6A through 6H show a process of applying the sealing cover according to the present invention to the container.

DESCRIPTION OF THE PREFERRED EMBODIMENTS

Hereinafter, an embodiment of the present invention will be described in detail with reference to the attached drawings.

The terms and words used in the specification and claims must not be limited to typical or dictionary meanings, but must be regarded as concepts selected by the inventor as concepts which best illustrate the present invention, and must be interpreted as having meanings and concepts adapted to the scope and spirit of the present invention to aid in understanding the technology of the present invention.

The present invention provides a sealing cover for a container which is formed of material having high thermal adhesive strength and heat resistance and is provided with an opening tab and an opening cutting line to facilitate opening of an aperture of the container, thus proving superior heat resistance and easy-opening performance.

Furthermore, the present invention provides a sealing cover for a container which is configured such that even after the aperture of the container is opened by means of the opening tab, a part of the sealing cover remains on a lip of the aperture of the container so that close contact between the container and a cap can be ensured when the container is closed.

Figure 1A:
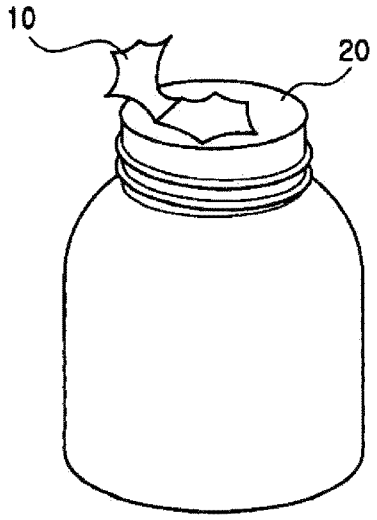
FIG. 1A (RELATED ART)
FIGS. 1A and 1B show examples of a conventional heat sealing cover having an opening tab.
Figure 1B:
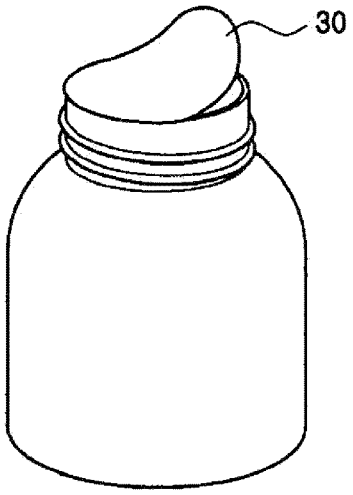
FIG. 1B (RELATED ART)
Figures 2A, 2B:
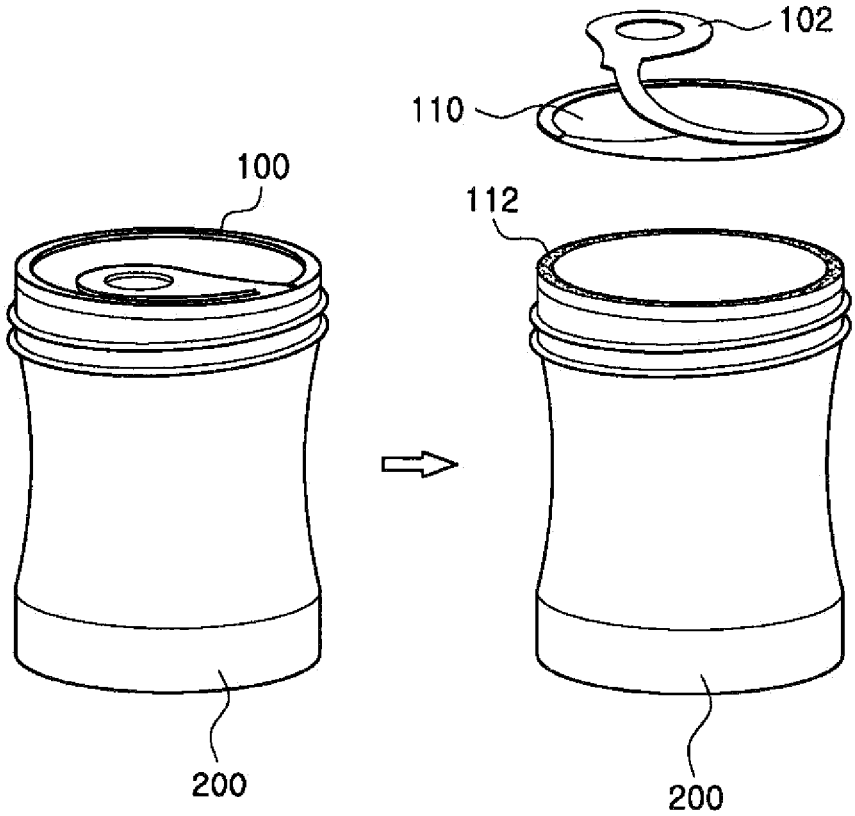
FIGS. 2A and 2B are perspective views illustrating a container provided with a sealing cover for containers according to an embodiment of the present invention.

FIGS. 2A and 2B are perspective views showing a container 200 provided with a sealing cover 100 for containers according to the present invention.

Referring to FIG. 2A, an aperture of the container 200 is sealed with the sealing cover 100 according to the present invention.

Referring to FIG. 2B, when an opening tab 102 is pulled, a central part 110 of the sealing cover 100 is separated from the container 200 so that the aperture of the container 200 enters an open state. Upon this, an annular perimeter part (112, a heat adhesive sealing band) of the sealing cover 100 other than the central part 110 remains on the lip of the aperture of the container 200.

Figure 3:
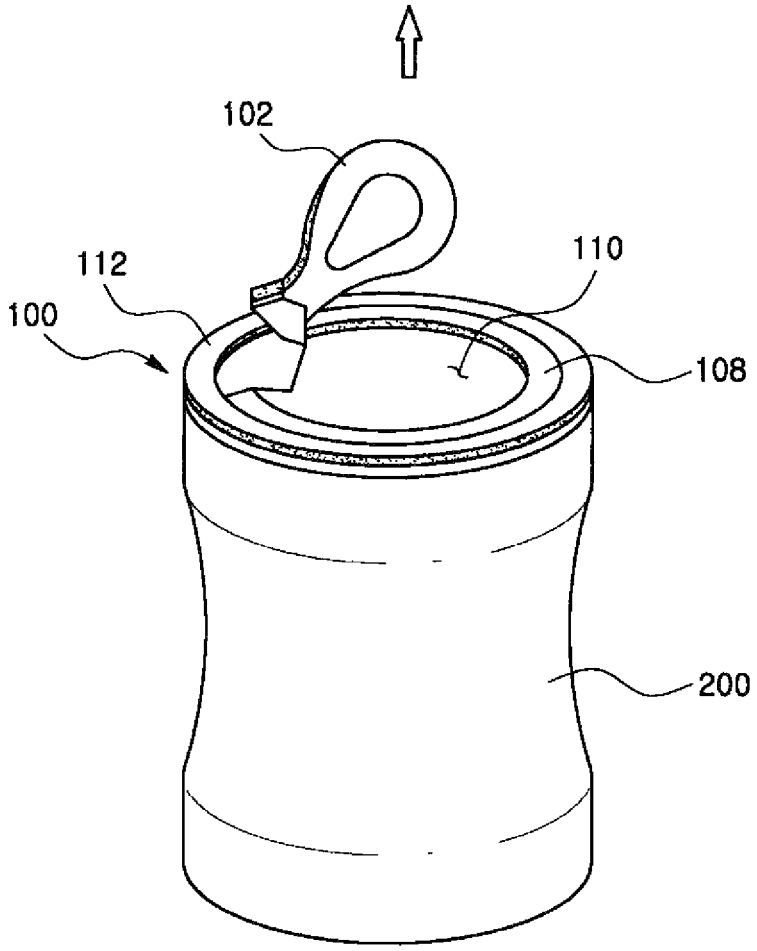
FIG. 3 illustrates pulling an opening tab of the sealing cover according to the present invention to open an aperture of the container.

FIG. 3 illustrates pulling the opening tab 102 of the sealing cover 100 according to the present invention to open the aperture of the container 200.

Referring to FIG. 3, if the opening tab 102 provided on an upper surface of the sealing cover 100 is pulled upwards, the central part 110 of the sealing cover 100 is separated from the container 200 along an opening guide band (not shown) formed around an inner circumferential surface of the aperture of the container 200.

Figure 4:
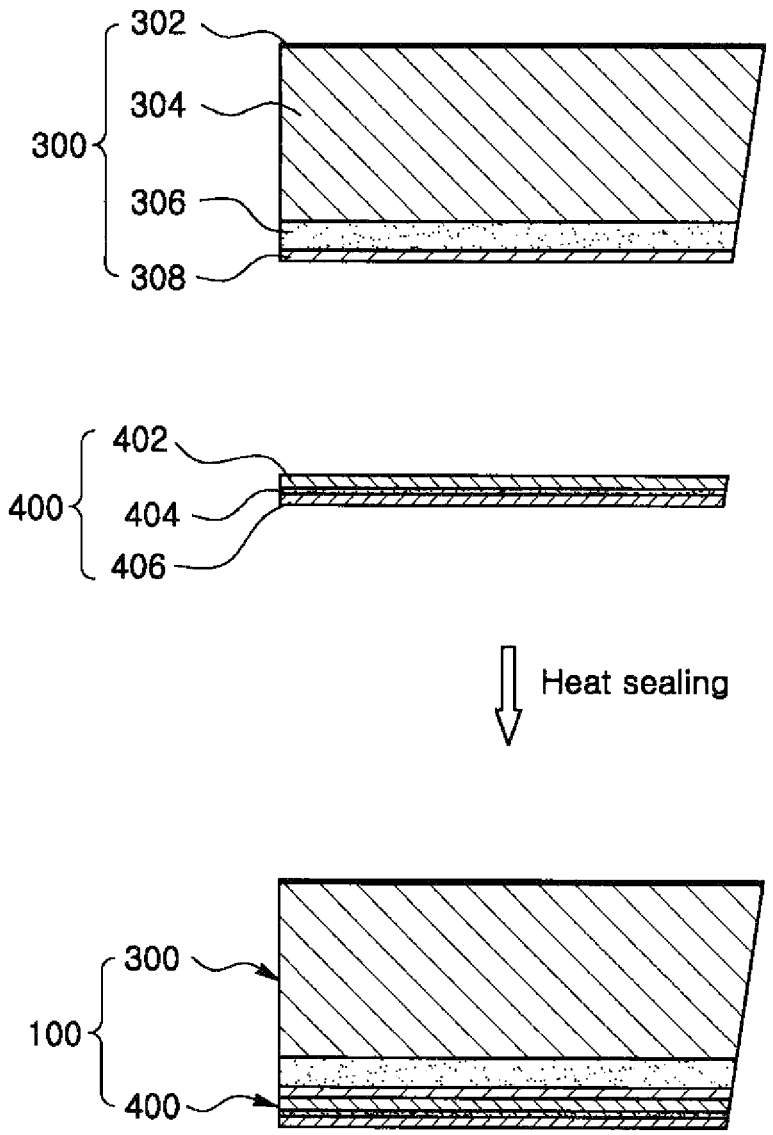
FIG. 4 illustrates a process of forming the sealing cover according to the present invention.

FIG. 4 illustrates a process of forming the sealing cover 100 according to the present invention.

Referring to FIG. 4, as will be described in more detail later herein, the sealing cover 100 according to the present invention is formed by forming an upper layer 300 provided with the opening tab 102 and a lower layer 400 having heat resistance, and then thermally adhering the upper layer 300 to the lower layer 400 to form an integrated body.

The upper layer 300 can be made of various kinds of plastic films, foams, etc. Based on FIG. 4, a surface layer 302 is disposed at the uppermost layer and is formed of a polyester film that has a thickness ranging from 0.012 mm to 0.025 mm and has no heat adhesive property. As needed, a variety of patterns may be printed on the surface layer 302.

An intermediate substrate layer 304 is disposed under the surface layer 302 and is a film or sheet that has a thickness ranging from 0.1 mm to 2 mm and is made of polyolefin-based foam. The intermediate substrate layer 304 is laminated under the surface layer 302.

When a cap 210 is coupled to the container 200, the close-contactability between the cap 210 and the container 200 is increased by the elasticity of the intermediate substrate layer 304. Furthermore, because the intermediate substrate layer 304 is formed of a foam sheet having an appropriate thickness, it can provide a heat insulation function of preventing heat generated from an aluminum foil 404 of the lower layer 400 by high-frequency induction heating from being transferred to the surface layer 302. Thereby, the cap 210 can be prevented from being deformed by heat generated during a thermal bonding operation.

A polyester film layer 306 that has a thickness ranging from 0.03 mm to 0.2 mm is laminated under the intermediate substrate layer 304. The polyester film layer 306 performs a very important function. In detail, thanks to the high tensile strength of the polyester film, sufficient tensile strength is given to the entire of the upper layer 300. Thereby, when the sealing cover 100 that has been sealed on the container 200 is removed from the container 200 to open the aperture thereof, the opening tab 102 of the upper layer 300 can be prevented from being snapped from a ring-shaped opening cutting band, and the opening tab 102 that is provided on the upper layer 300 and the central part 110 of the sealing cover 100 that is disposed inside the annular opening cutting line can be easily cut off.

Having heat adhesive properties and having a thickness ranging from 0.02 mm to 0.06 m, a first polypropylene film layer 308 is laminated under the polyester film layer 306. The first polypropylene film layer 308 thermally adheres to a second polypropylene film layer 402 that is disposed at the uppermost layer of the lower layer 400 and is made of the same thermal adhesive material as that of the first polypropylene film layer 308.

As described above, in the lower layer 400 which is heat-sealed on the container 200, the second polypropylene film layer 402 which has heat adhesive properties is disposed at the uppermost layer, and the aluminum foil 404 that has an appropriate thickness ranging from 0.012 mm to 0.1 mm is laminated under the second polypropylene film layer 402. The aluminum foil 404 generates heat resulting from high-frequency induction heating and functions to substantially isolate the interior of the container 200 from the outside.

A heat sealing adhesive layer 406 is applied to a lower surface of the aluminum foil 404 by laminating or coating. In the case of the container 200 that is made of polypropylene which is suitable for retort, the heat sealing adhesive layer 406 is formed of a polypropylene film which has heat adhesive properties and has an appropriate thickness ranging from 0.03 mm to 0.1 am. If container 200 is made of material such as glass, polyethylene or polyethylene terephthalate, the heat sealing adhesive layer 406 is coated with a polyethylene, polyethylene terephthalate, ionomer or ethylene vinyl acetate film or resin (polymer) which has heat adhesive properties.

Having the above-mentioned structures, the upper layer 300 and the lower layer 400 thermally adhere to each other, thus forming the sealing cover 100. Before the upper layer 300 thermally adheres to the lower layer 400, an opening tab 102, an opening guide cutting line 104, an opening cutting line 106 and an annular opening guide cutting band 108 are formed in the upper layer 300.

Figure 5A:
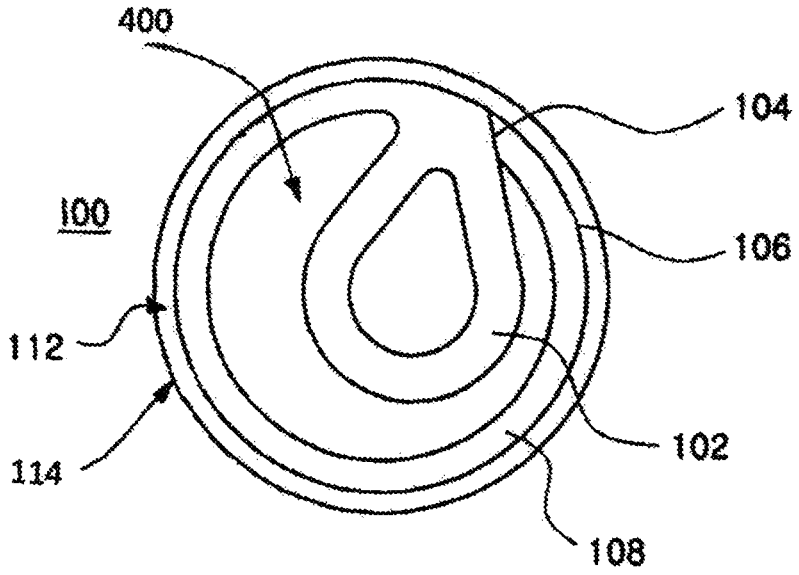
FIGS. 5A and 5B illustrate, in a tot view and in a side elevational view, respectively, the structure of an upper layer of the sealing cover according to the present invention.
Figure 5B:
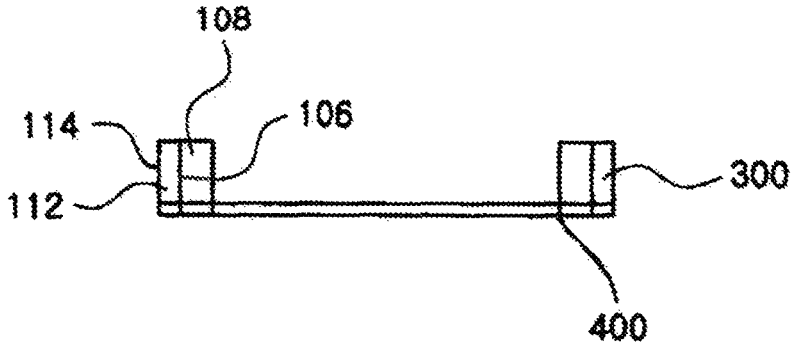

FIG. 5 illustrates the structure of the upper layer 300 of the sealing cover 100 according to the present invention.

Referring to FIG. 5, the upper layer 300 of the sealing cover 100 according to the present invention includes the opening tab 102, the opening guide cutting line 104, the opening cutting line 106, the opening guide cutting band 108, an outer cutting line 114 and the heat adhesive sealing band 112. That is, after the opening tab 102, the opening guide cutting line 104, the opening cutting line 106 and the outer cutting line 114 are formed in the upper layer 300 that has the structure illustrated in FIG. 4, unnecessary portions are cut off from the upper layer 300 such that the opening tab 102, the opening guide cutting band 108 and the heat adhesive sealing band 112 are formed in the upper layer 300.

The upper layer 300, in which the opening tab 102, the opening guide cutting line 104, the opening cutting line 106, the annular opening guide cutting band 108, the heat adhesive sealing band 112, etc. are formed, thermally adheres to the lower layer 400. The opening guide cutting line 104 is a cutting line which is formed between the opening tab 102 and the opening cutting line 106. The term "cutting line" refers to a line which makes the lower layer 400 be easily torn when the opening tab 102 is pulled.

Referring to FIG. 5 again, heat adhesion is applied only to the opening guide cutting band 108 other than the opening tab 102 and to the heat adhesive sealing band 112 which substantially adheres to the container. As such, only the annular bands 108 and 112, the upper layer 300 and the lower layer 400 thermally adhere to each other. Finally, a cutting or punching operation is conducted in accordance with the outer cutting line 114, meeting standard requirements of the container, thus completing the sealing cover 100.

The principle of opening the aperture of the container 200 using the opening tab 102 is as follows.

Referring to FIG. 5 again, when a user grasps the opening tab 102 that has not thermally adhered to the lower layer 400 with his/her hand and pulls it upwards, beginning with the opening guide cutting line 104 at which the upper layer 300 has thermally adhered to the lower layer 400, the annular opening guide cutting band 108 is pulled in an upward and circumferential direction along the opening cutting line 106. Then, the lower layer 400 is separated from the container in such a way that it is torn or cut out along the opening cutting line 106 of the upper layer 300 that has been previously cut. As a result, the aperture of the container 200 can be opened.

FIGS. 6A through 6H show a process of applying the sealing cover 100 to the container 200.

As shown in FIGS. 6A through 6D, the sealing cover 100 according to the present invention is installed in the cap 210.

Thereafter, as shown in FIG. 6E, the cap 210 is coupled to the container 200, and then the sealing cover 100 is bonded and sealed on the aperture of the container 200 by induction heating.

To use contents contained in the container 200, the user first removes the cap 210 from the container 200 as shown in FIG. 6F. Thereafter, the user grasps the opening tap 102 and pulls it upwards as shown in FIG. 6G, thus opening the aperture of the container 200. An annular perimeter part 112 of the sealing cover 100 other than the central part 110 remains on the lip of the aperture of the container 200 as shown in FIG. 6H.

As described above, in a sealing cover for containers according to the present invention, the sealing cover provided with an aluminum foil is configured such that it is firmly thermally sealed on the aperture of a container, whereby contents in the container can be reliably protected.

Furthermore, the sealing cover according to the present invention has therein an opening tab, an opening guide cutting line, an opening cutting line and an opening guide cutting band, so that opening the aperture of the container can be facilitated.

Moreover, the sealing cover according to the present invention provides not only a primary sealing effect before the container opens but also a secondary sealing effect in which because a part of the sealing cover remains on a lip of an aperture of the container in an annular shape after the container has been opened, and when the cap is coupled to the container again, the close contact between the container and the cap can be ensured by the elasticity and the shock absorbing effect of the sealing cover, thus reliably preventing contents from leaking.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A sealing cover configured to seal a container, the sealing cover comprising:

an upper layer patterned to include:

a heat adhesive sealing band configured to be disposed over a lip of the container and shaped substantially as a ring;

an opening guide cutting band disposed along an inner circumference of the heat adhesive sealing band and shaped substantially as a ring;

an opening cutting line formed between the heat adhesive sealing band and the opening guide cutting band; and an opening tab seamlessly and integrally formed with the opening guide cutting band and extending from an end of the opening guide cutting band, and an empty portion formed inside the ring shade of the opening guide cutting band in which the opening tab resides, a lower layer thermally adhered to the heat adhesive sealing band and the opening guide cutting band, wherein each of the heat adhesive sealing band, the opening guide cutting band, and the opening tab of the upper layer includes:

a surface layer formed of a polyester film or a polypropylene film;

a first polypropylene film layer laminated to the surface layer;

an elastic intermediate substrate layer laminated between the surface layer and the first polypropylene film layer and formed of a polyolefin-based foam film; and a polyester film layer laminated between the intermediate substrate layer and the first polypropylene film layer, wherein the lower layer includes:

a second polypropylene film layer thermally adhered to the first polypropylene film layer of the upper layer;

an aluminum foil laminated to the second polypropylene film layer; and a heat sealing adhesive layer laminated to the aluminum foil.

2. The sealing cover as set forth in claim 1, wherein the aluminum foil is laminated under the second polypropylene film and has a thickness ranging from 0.012 mm to 0.1 mm.

3. The sealing cover as set forth in claim 2, wherein the heat sealing adhesive layer is laminated under the aluminum foil and is formed of a heat-adhesive polypropylene withstanding a temperature of 130° C. or more and having a thickness ranging from 0.02 mm to 0.08 mm.

4. The sealing cover as set forth in claim 1, wherein the heat sealing adhesive layer is formed of one selected from among polyethylene, polyethylene terephthalate, ionomer and ethylene vinyl acetate.

5. The sealing cover as set forth in claim 1, wherein an opening guide cutting line is formed where the opening tab extends from the opening guide cutting band.

6. The sealing cover as set forth in claim 1, wherein the opening guide cutting band extends from an end of the opening tab and connects to an opposite end of the opening tab.

7. The sealing cover as set forth in claim 1, wherein the heat-adhesive sealing band is configured to remain attached to the lip of the container after the opening guide cutting band and the opening tab are removed.

* * * * *